US005090386A

United States Patent [19]

Kurosu et al.

[11] Patent Number: 5,090,386

[45] Date of Patent: Feb. 25, 1992

[54] FUEL INJECTION CONTROL SYSTEM FOR AN INTERNAL COMBUSTION ENGINE

[75] Inventors: Shinichi Kurosu, Ageo; Mitsugi Chonan, Koga; Fusao Tachibana; Hideyuki Ishikawa, both of Saitama; Yoshiki Yuzuriha, Isezaki, all of Japan

[73] Assignees: Fuji Jukogyo Kabushiki Kaisha, Tokyo; Japan Electronic Control Systems Co., Ltd., Isezaki, both of Japan; Polaris Industries L.P., Minneapolis, Minn.

[21] Appl. No.: 603,275

[22] Filed: Oct. 25, 1990

[51] Int. Cl.[5] ..... F02M 51/00

[52] U.S. Cl. ..... 123/478

[58] Field of Search ..... 123/478, 198 DB, 497, 123/452; 180/177

[56] References Cited

U.S. PATENT DOCUMENTS

| | | | |
|---|---|---|---|
| 3,974,809 | 8/1976 | Shampp et al. | 123/452 |
| 4,800,859 | 1/1989 | Sagisaka et al. | 123/497 |
| 4,877,101 | 8/1976 | Tada et al. | 123/198 DB |

FOREIGN PATENT DOCUMENTS

| | | | |
|---|---|---|---|
| 63-29039 | 2/1988 | Japan | 123/478 |
| 63-255543 | 10/1988 | Japan | 123/478 |

*Primary Examiner*—Raymond A. Nelli
*Attorney, Agent, or Firm*—Martin A. Farber

[57] ABSTRACT

An ignition device intermittently produces an ignition voltage in synchronism with speed of an engine. A fuel injection control is provided for operating a fuel injector for injecting fuel. A fuel pump for supplying fuel to the fuel injector is stopped at a time after the ignition and fuel injection stop, thereby keeping fuel pressure in a fuel supply passage.

8 Claims, 17 Drawing Sheets

FUEL INJECTION CONTROL SYSTEM FOR AN INTERNAL COMBUSTION ENGINE

BACKGROUND OF THE INVENTION

The present invention relates to a fuel injection control system for an internal combustion engine having an electronic control system such as a microcomputer.

A fuel injection control system having a microcomputer is widely used in a four-cycle engine.

A recent two-cycle engine is also equipped with an electronic control system for controlling various components of the engine, such as fuel injectors. Japanese Patent Application Laid-Open 63-255543 discloses such an electronic fuel injection control system for the engine. The system has a main intake pipe for inducing fresh air into a crankcase and a sub intake pipe for directly inducing fresh air into the crankcase. A fuel injector is provided in each of the intake pipes. An electronic control unit is provided for controlling the injection timing and quantity of fuel injected from the fuel injector Japanese Patent Application Laid-Open 63-29039 discloses a system in which the quantity of intake air Q is derived from a look-up table in accordance with throttle valve opening degree $\alpha$ and engine speed N as parameters for calculating a basic fuel injection quantity Tp. Fuel injection quantity is calculated by correcting the basic fuel injection quantity with various correcting quantities in accordance with engine operating conditions. In general, the engine speed N is calculated from output data detected by a speed sensor such as a crank angle sensor and the fuel injection is controlled in synchronism with the crank angle.

When an ignition switch is turned off to stop the engine, the fuel injection operation of the fuel injector stops and a fuel pump stops supplying the fuel.

However, if the fuel injector operates so as to inject fuel after the stopping of supplying the fuel because of a delay of stopping the energization of the fuel injector, the fuel pressure in the fuel supply passage drops. Therefore, if the engine is restarted in such a state, although, the fuel pump starts to supply fuel to the injector, the fuel pressure does not increase immediately. Consequently, the quantity of injected fuel is small because of the low fuel pressure, causing a poor starting characteristic of the engine.

SUMMARY OF THE INVENTION

The object of the present invention is to provide a fuel injection control system for an engine in which fuel pressure is held at a proper value when the engine stops, thereby obtaining a good starting characteristic of the engine.

Other objects and features of this invention will become understood from the following description with reference to the accompanying drawings.

DETAILED DESCRIPTION OF THE PREFERRED EMBODIMENTS

Figure 1A:
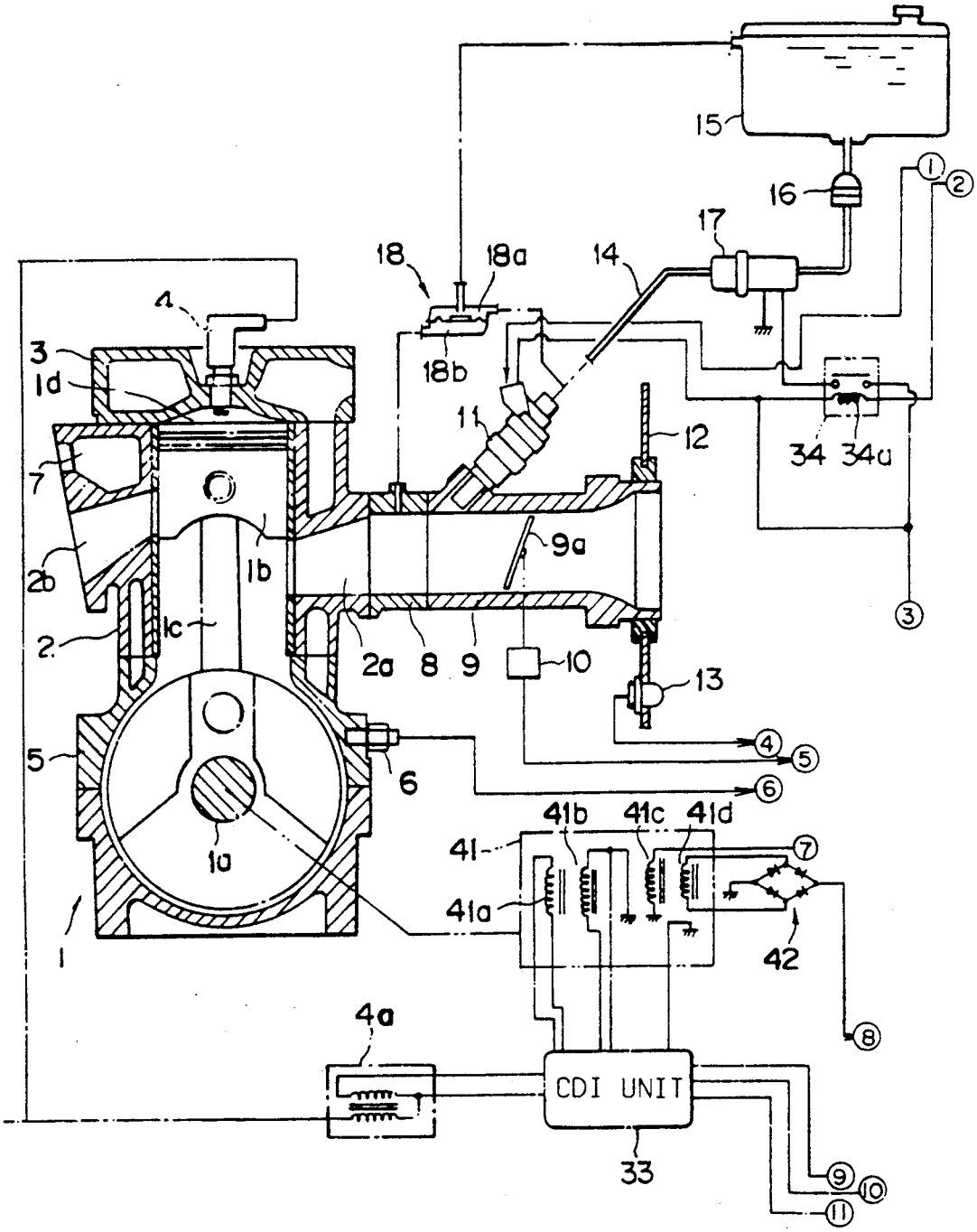
FIGS. 1*a* to 1*c* are schematic diagrams showing a control system for an engine including a circuit of the present invention.
Figure 1B:
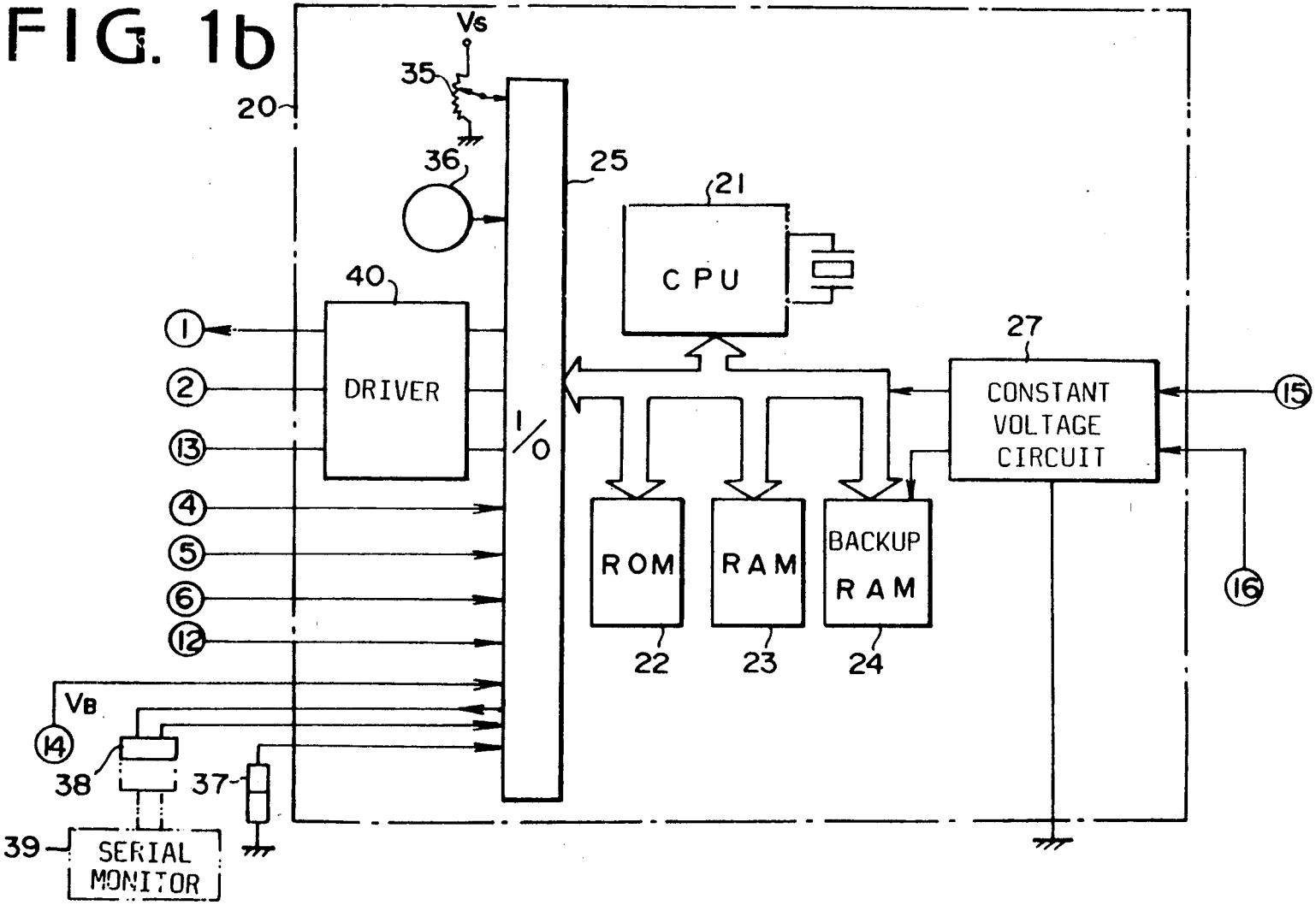
Figure 1C:
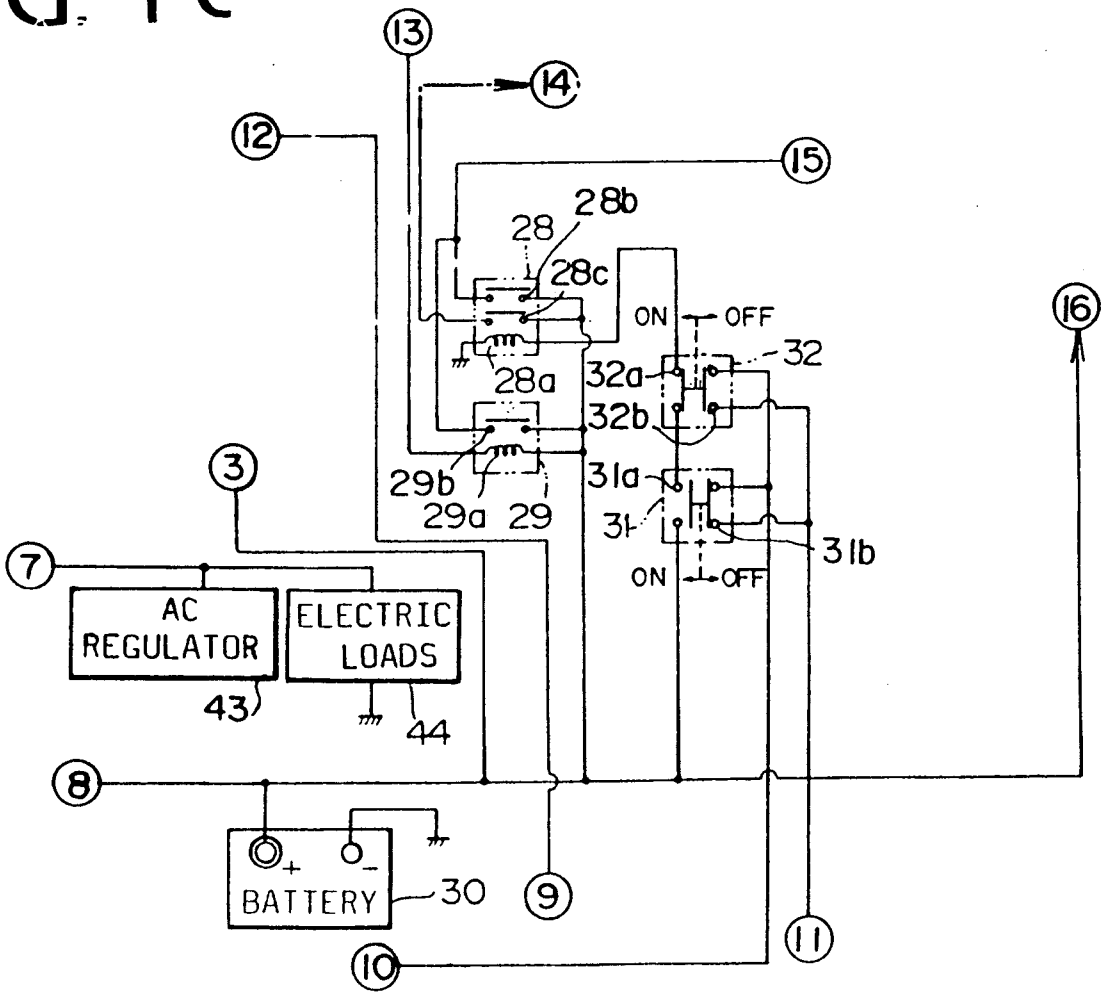

Referring to FIGS. 1*a* to 1*c* showing a two-cycle three-cylinder engine 1 for a snowmobile, a cylinder 2 of the engine 1 has an intake port 2*a* and an exhaust port 2*b*. A piston 1*b* is provided in the cylinder 2 and defines a combustion chamber 1*d* therein. A connecting rod 1*c* is connected with the piston 1*b* and a crankshaft 1*a* disposed in a crankcase 5. A spark plug 4 is located in each combustion chamber 1*d* deformed in a cylinder head 3. A crankcase temperature sensor 6 is provided on the crankcase 5. Water jackets 7 are provided in the crankcase 5, cylinder 2 and cylinder head 3. The intake port 2*a* is communicated with an intake manifold 9 through an insulator 8. A throttle valve 9*a* is provided in the intake manifold 9. A throttle position sensor 10 is attached to the intake manifold 9. A fuel injector 11 is provided in the intake manifold 9 adjacent the intake port 2*a*. The intake manifold 9 is communicated with an air box 12 having an air cleaner (not shown). An intake air temperature sensor 13 is mounted on the air box 12.

Fuel in a fuel tank 15 is supplied to the injector 11 through a fuel passage 14 having a filter 16 and a fuel pump 17.

The fuel injector 11 is communicated with a fuel chamber 18*a* of a pressure regulator 18 and the fuel tank 15 is communicated with an outlet of the fuel chamber 18*a*. A pressure regulating chamber 18*b* is communicated with the intake manifold 9.

The fuel in the tank 15 is supplied to the fuel injector 11 and the pressure regulator 18 by the pump 17 through the filter 16. The difference between the inner pressure of the intake manifold 9 and the fuel pressure applied to the injector 11 is maintained at a predetermined value by the pressure regulator 18 so as to prevent the fuel injection quantity of the injector 11 from changing.

An electronic control unit (ECU) 20 having a microcomputer comprises a CPU (central processing unit) 21, a ROM 22, a RAM 23, a backup RAM 24 and an input/output interface 25, which are connected to each other through a bus line 26. A predetermined voltage is supplied from a constant voltage circuit 27. The constant voltage circuit 27 is connected to a battery 30 through a contact 28*b* of an ECU relay 28, and a contact 29*b* of a self-shut relay 29 which are connected in parallel with each other. Furthermore, the battery 30 is directly connected to the constant voltage circuit 27 so that the backup RAM 24 is backed up by the battery 30 so as to maintain the stored data even if a key switch (not shown) is in an off-state. Sensors 6, 10 and 13 are connected to input ports of the input/output interface 25. An atmospheric pressure sensor 36 is provided in the control unit 20 and connected to an input port of the input/output interface 25. Further, an MR resistor 35 is connected to a standard voltage VS to apply a divided voltage to the input port of the I/0 interface 25. The MR resistor 35 is provided for adjusting the idle speed of the engine. When the engine idles, the CPU 21 of the control unit 20 reads the adjusting voltage from the MR resistor 35 to calculate the pulse width corresponding to the adjusting voltage. The pulse width is added to or subtracted from the basic fuel injection pulse width, so that the idle speed of the engine is adjusted. Output ports of the interface 25 are connected to a driver 40 which is connected to injectors 11 and a coil 34*a* of a relay 34 for the pump 17.

The ECU relay 28 has a pair of contacts 28*b* and 28*c* and an electromagnetic coil 28*a*. As hereinbefore described, the contact 28*b* is connected to the constant voltage circuit 27 and the battery 30. The other contact 28*c* is connected to the input port of the I/0 interface 25 and the battery 30 for monitoring the voltage VB of the battery 30. The coil 28*a* of the relay 28 is connected to the battery 30 through ON-terminals 32*a*, 31*a* of a kill switch 32 and an ignition switch 31.

The kill switch 32 is provided on a grip (not shown) of the snowmobile to stop the snowmobile.

ON-terminals 31*a* and 32*a* of the ignition switch 31 and the kill switch 32 are connected to each other in series and OFF-terminals 31*b* and 32*b* of switches 31 and 32 are connected to each other in parallel. When both the switches 31 and 32 are turned on, power from the battery 30 is supplied to the coil 28*a* of the relay 28 to excite the coil to close each contact. Thus, the power from the battery 30 is supplied to the constant voltage circuit 27 through the contact 28*b* for controlling the control unit 20.

The self-shut relay 29 has the contact 29*b* connected to the constant voltage circuit 27 and the battery 30 and a coil 29*a* connected to the output port of the I/O interface 25 through the driver 40 and the battery 30.

When one of the switches 31 and 32 is turned off, the engine stops. After the stopping of the engine, the power from the battery 30 is supplied to the coil 29*a* of the self-shut relay 29 for a predetermined period (for example, ten minutes) by the operation of the control unit, thereby supplying the power to the control unit 20 for the period.

When the engine is restarted while the engine is warm within the period, the quantity of fuel injected from the injector 11 is corrected to a proper value, so that restarting of the engine in a hot engine condition is ensured.

The battery 30 is further connected to the coil 34*a* of the fuel pump relay 34 and to the injector 11 and the pump 17 through a contact of the relay 34.

As a self-diagnosis function of the system, a connector 37 for changing a diagnosis mode and a connector 38 for diagnosing the engine are connected to the input ports of the I/O interface 25. A serial monitor 39 is connected to the control unit 20 through the connector 38. The trouble mode changing connector 37 operates to change the self-diagnosis function of the control unit 20 into either a U(user)-check mode or D(dealer)-check mode. In normal state, the connector 37 is set in the U-check mode. When an abnormality occurs in the system during the driving of the vehicle, trouble data are stored and kept in the backup RAM 24. At a dealer's shop, the serial monitor 39 is connected through the connector 38 to read the data stored in the RAM 24 for diagnosing the trouble of the system. The connector 37 is changed to the D-check mode to diagnose the trouble more in detail.

Furthermore, a CDI unit 33 is provided as an ignition device. The CDI unit 33 is connected to a primary coil of an ignition coil 4*a* and to the spark plug 4 through a secondary coil. A signal line of the CDI unit 33 is connected to the input port of the I/O interface 25 of the control unit 20 for applying CDI pulses. When one of the switches 31 and 32 is turned off, lines for the CDI unit are short-circuited to stop the ignition operation.

A magneto 41 for generating alternating current is connected to the crankshaft 1*a* of the engine 1 to be operated by the engine. The magneto 41 has an exciter coil 41*a*, a pulser coil 41*b*, a lamp coil 41*c*, and a charge coil 41*d*. The exciter coil 41*a* and pulser coil 41*b* are connected to the CDI unit 33. The lamp coil 41*c* is connected to an AC regulator 43 (FIG. 1*c*), so that the voltage is regulated, and the regulated voltage is applied to an electric load 44 such as lamps, a heater and various accessories of the vehicle. Namely, the regulated output of the magneto is independently supplied to the electric load 44. The charge coil 41*d* is connected to the battery 30 through a rectifier 42.

Figure 3A:
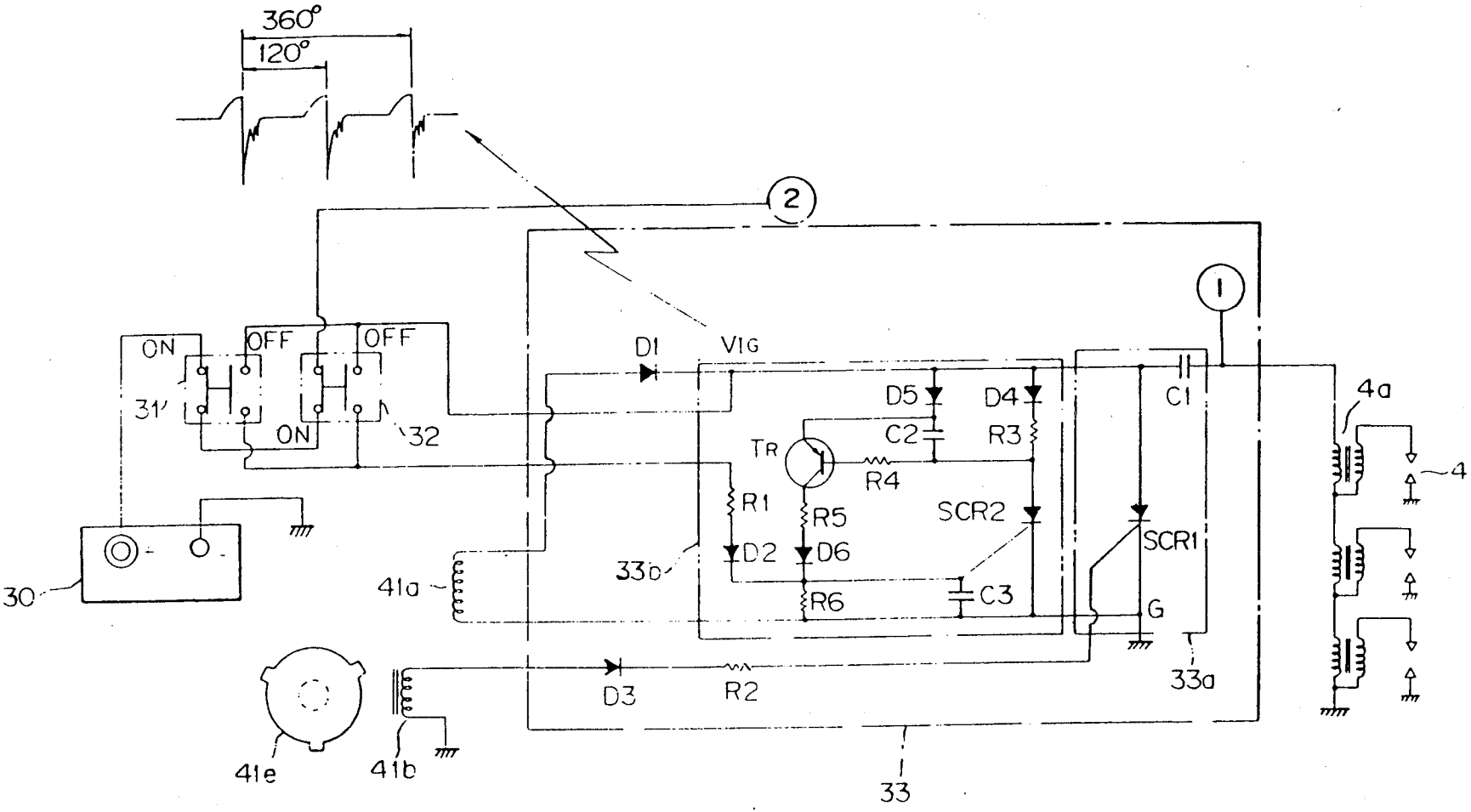
FIGS. 3*a* and 3*b* are a circuit showing a CDI unit provided in the control system.
Figure 3B:
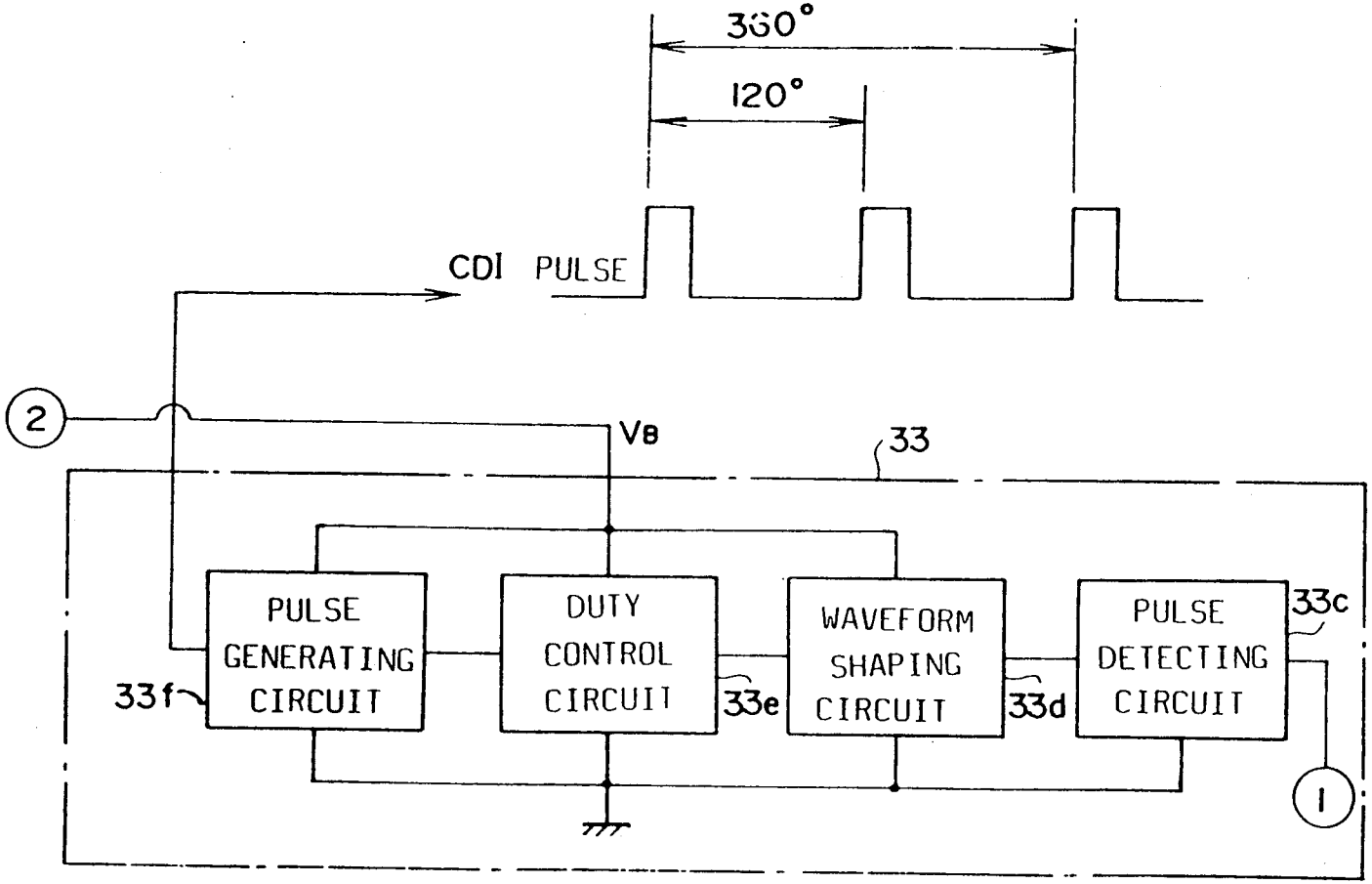

Referring to FIGS. 3*a*, 3*b* showing the CDI unit 33, the exciter coil 41*a* is connected to an ignition source VIG of an ignition source short-circuiting circuit 33*b* through a diode D1. The ignition source short-circuiting circuit 33*b* has a first diode D4 and a second diode D5 anodes of which are connected to the source VIG. Cathodes of the diodes D4 and D5 are connected to an anode of a thyristor SCR2 through a resistor R3 and a capacitor C2, respectively. A cathode of the thyristor SCR2 is connected to the ground G. The cathode of the second diode D5 is further connected to an emitter of a PNP transistor TR. A base of the transistor TR is connected to the anode of the thyristor SCR2 through a resistor R4. A collector of the transistor TR is connected to a gate of the thyristor SCR2 through a resistor R5 and a diode D6. A resistor R6 and a capacitor C3 are connected between the gate of the thyristor SCR2 and the ground G in parallel to each other for preventing noise and commutation caused by an increasing rate of critical off voltage.

OFF-terminals of the ignition switch 31 and the kill switch 32 are connected to the source VIG and to the gate of the thyristor SCR2 through a resistor R1 and a diode D2.

An ignition circuit 33*a* is a well-known capacitor discharge ignition circuit and comprises a capacitor C1 and a thyristor SCR1 to which the source VIG is connected. The pulser coil 41*b* is connected to a gate of the thyristor SCR1 through a diode D3 and a resistor R2. The pulser coil 41*b* is provided adjacent a crank angle sensor disk 41*e* of the magneto 41.

Figure 4:
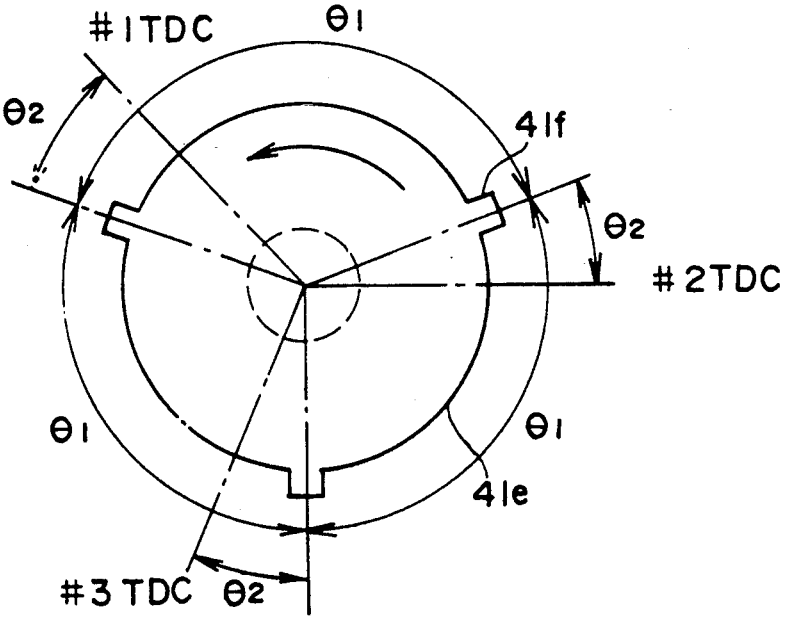
FIG. 4 is a front view showing a crank angle disk in the CDI unit.

Referring to FIG. 4, the crank angle sensor disk 41*e* has three projections (notches) 41*f* formed on an outer periphery thereof at equal intervals $\theta 1$ (120 degrees). The projections 41*f* represent the before top dead center (BTDC) $\theta 2$ (for example 15 to 20 degrees) of No. 1 to No. 3 cylinders. When the disk 41*e* is rotated, the pulser coil 41*b* detects the positions of the projections 41*f* in accordance with electromagnetic induction and produces an ignition trigger signal in the form of a pulse.

The trigger signal is applied to the thyristor SCR1 at a predetermined timing. The thyristor SCR1 is connected to the ground G. The capacitor C1 is connected to the primary coils 4a of the spark plugs 4 and to a pulse detecting circuit 33c (FIG. 3b).

The CDI unit 33 further comprises a waveform shaping circuit 33d, a duty control circuit 33e and a pulse generating circuit 33f which are connected to the battery 30 through ON-terminals of the kill switch 32 and the ignition switch 31. The pulse generating circuit 33f produces CDI pulse signals (FIG. 3b) in synchronism with the source VIG. The CDI pulse signals are applied to the I/O interface 25 of the control unit 20 as hereinbefore described.

In the present invention, the pulser coil 41b produces an ignition trigger signal at every crank angle 120° to ignite three cylinders at the same time. The pulse generating circuit 33f produces a CDI pulse signal at every crank angle 120° to inject fuel from the fuel injectors 11 in three cylinders at the same time.

Figure 2A:
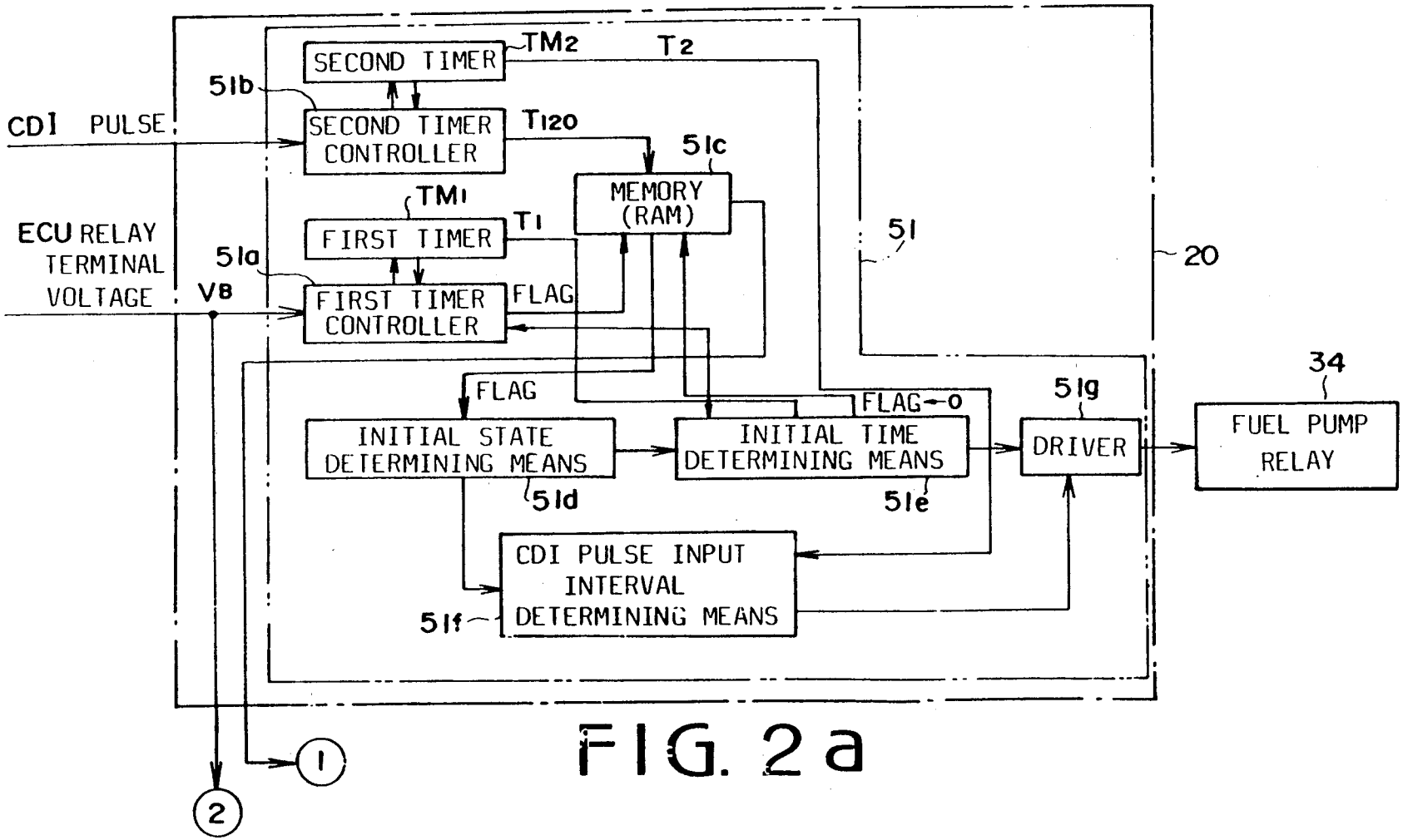
FIGS. 2*a* and 2*b* show a block diagram of the control system.
Figure 2B:
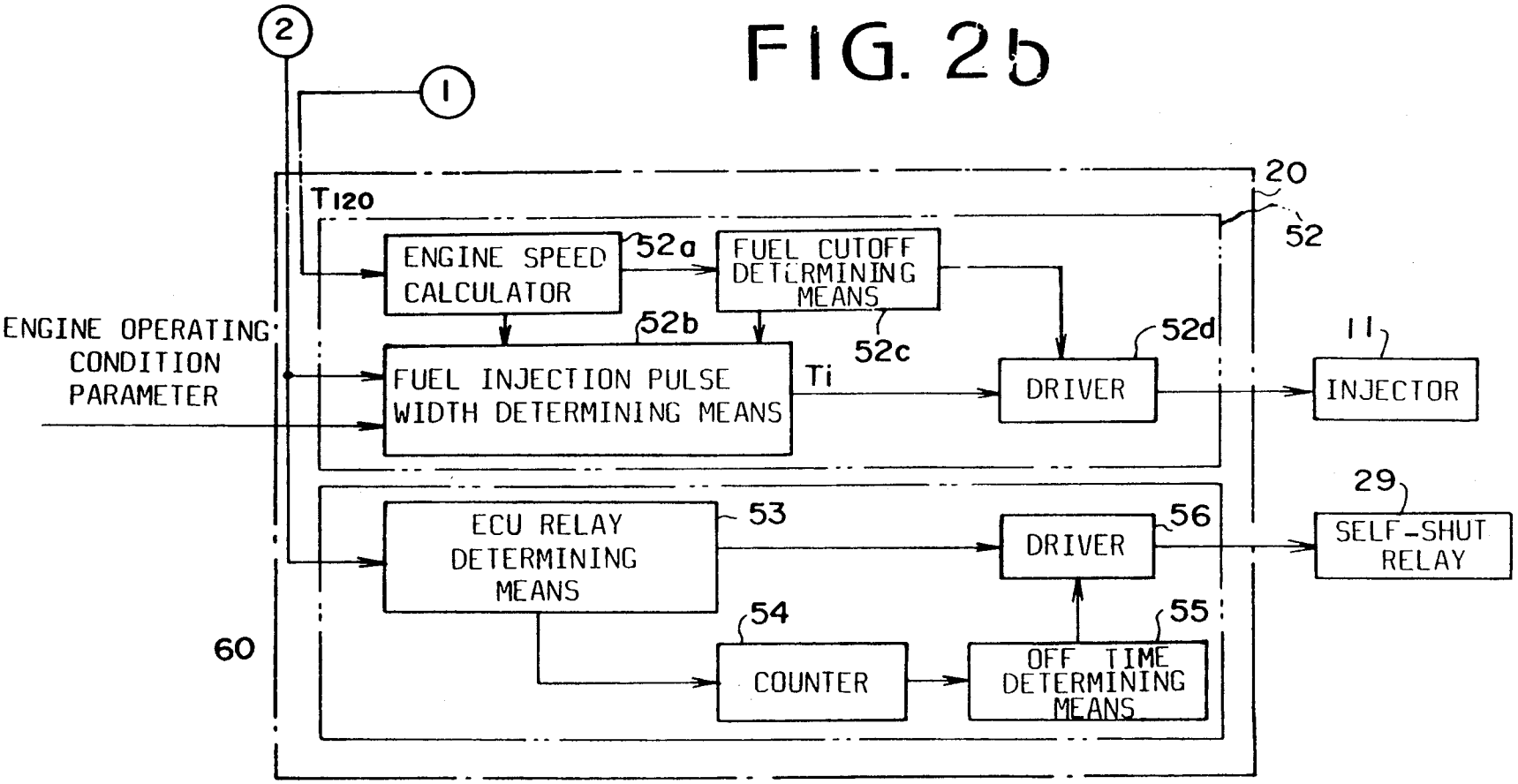

Referring to FIGS. 2a, 2b the electronic control unit 20 comprises a fuel pump control section 51, a fuel injection control section 52 and a self-shut control section 60.

The fuel pump control section 51 has a first timer controller 51a to which the voltage VB of the battery 30 is applied through the contact 28c of the ECU relay 28. When the voltage VB is applied, the controller 51a determines that the ECU relay 28 is turned on and operates to initialize a first timer TM1. The first timer TM1 actuates to start measuring time. The controller 51a further operates to set an initial state determining flag FLAG in a memory 51c (RAM 23) (FLG ←1). The first timer TM1 produces a measured time T1 which is applied to an initial time determining means 51e. The initial time determining means 51e compares the measured time T1 and a predetermined set time T1SET (for example 1 sec.). When T1<T1SET, the means 51e produces a signal which is applied to a driver 51g to turn on the fuel pump relay 34 for driving the fuel pump 17. When T1≧T1SET, the means 51e produces a signal which is applied to the first timer controller 51a to reset the first timer TM1 and further produces a signal which is applied to the memory 51c for resetting the initial state determining flag FLAG (FLAG←0).

The CDI pulse signal is applied to a second timer controller 51b. The controller 51b sends a signal to a second timer TM2 at every CDI pulse signal and reads an elapsed time T2 measured by the second timer TM2. The elapsed time T2 is stored in the memory 51c as an input time interval T120 of the CDI pulse (T120←T2). Then, the controller 51b operates to reset the second timer TM2 and to actuate the second timer to start measuring time.

The CDI pulse input interval time T120 is an elapsed time corresponding to the crank angle $\theta 1$ (120 degrees) between projections 41f of the disk 41e. The input interval time T120 is a parameter for calculating the engine speed. The measured time T2 namely the elapsed time after the input of the CDI pulses is applied to a CDI pulse input interval determining means 51f.

In the interval determining means 51f, the time T2 is compared with a predetermined set time T2SET which represents a limit time for stopping the fuel pump (for example 1 +A sec.: where A is 1 bit of minimum resolution corresponding to the time in the control unit 20). When T2≧T2SET, the means 51f decides to cut off the fuel pump. More particularly, when either the ignition switch 31 or the kill switch 32 is turned off, and the CDI pulse signal is not applied to the second timer controller 51b during the set time T2SET, the means 51f produces a signal which is applied to the driver 51g to turn off the fuel pump relay 34 to stop the operation of the pump 17. When T2<T2SET, the means 51f determines that the engine is in a normal running state and produces a signal to turn on the relay 34 through the driver 51g so that the pump 17 is driven.

An initial state determining means 51d is provided for detecting the initial state determining flag FLAG in the memory 51c. When FLAG=1, the means 51d determines that the engine is in initial state after the ECU relay 28 is turned on, and produces a signal which is applied to an initial time determining means 51e to actuate it. When FLAG=0, it is determined that the initial state of the engine is terminated, and a signal is applied to the DCI pulse input interval determining means 51f to actuate it.

The fuel injection control section 52 comprises an engine speed calculator 52a in which a period f is obtained in accordance with the CDI pulse input interval T120 stored in the memory 51c and the crank angle $\theta 1$ ($f = dT120/d\theta 1$) to calculate engine speed N ($N = 60/2\pi f$). A fuel injection pulse width determining means 52b determines a fuel injection pulse width Ti based on the engine speed N, the battery voltage VB, and engine operating condition parameters such as throttle opening degree $\alpha$ detected by the throttle position sensor 10, crankcase temperature Tmc by the crankcase temperature sensor 6, atmospheric pressure Pa by the atmospheric pressure sensor 36, and intake air temperature Ta by the intake air temperature sensor 13. A drive signal in dependency on the fuel injection pulse width Ti is applied to the fuel injector 11 through a driver 52d for injecting a predetermined amount of fuel from the injector.

A fuel cutoff determining means 52c is provided for comparing the engine speed N with a predetermined set value NSET representing a limit speed for stopping fuel injection. When N<NSET, the fuel cut off determining means 52c determines that the engine speed N is reduced in accordance with the cutoff of the ignition. The means 52c produces a signal which is applied to the fuel injection pulse width determining means 52b to stop calculating the fuel injection pulse width Ti. A signal of Ti=0 is applied to the driver 52d to cut off the fuel, namely to stop injecting fuel from the injector 11. When N≧NSET, the means 52c determines that the engine is cranking or in a normal operating state and a signal is applied to the means 52b to actuate the calculation of fuel injection pulse width.

The set value NSET is set to 50 rpm (period 1.2 sec.) which corresponds to 0.4 sec. of the CDI pulse input interval T120. Namely, the set value T2SET is larger than the set value NSET. Thus, when the engine stops, the fuel injection is stopped first, and the operation of the fuel pump 17 is stopped next.

Consequently, reduction of the fuel pressure is surely prevented.

The self-shut control section 60 comprises an ECU relay condition determining means 53 to which the battery voltage VB is applied for determining whether the ECU relay 28 is on or off. When the ECU relay 28 is on, the determining means 53 produces a drive signal which is applied to a driver 56 to energize the self-shut relay 29. When the relay 28 is energized, a drive signal is applied to a counter 54 for actuating the counter. The counter 54 starts counting an elapsed time after the ECU relay 28 is turned off and produces a count C which is applied to an OFF time determining means 55.

The counter 54 is operated as a timer which counts a standard time clock pulse which is produced by dividing the system clock pulses of the control unit 20.

The OFF time determining means 55 determines whether the count C of the counter 54 exceeds a predetermined standard time CSET for turning off the self-shut relay 29 (for example ten minutes). When C<CSET, the means 55 produces a signal for maintaining the self-shut relay 29 in on state through the driver 56. When C≧CSET, it is determined that the ECU relay 28 is in off-state for the period, and a signal is applied to the driver 56 to turn off the self-shut relay 29.

The standard time CSET is obtained by experiments in consideration of the period to cool the engine.

When the driver 56 is applied with the drive signal from the ECU relay condition determining means 53, the driver 56 operates to excite the coil 29*a* of the self-shut relay 29 to turn on the relay 29. When the signal from the OFF time determining means 55 is applied, the coil 29*a* is de-energized to turn off the relay 29. Thus, the power to the control unit 20 is cut off to stop the operation of the system.

Describing the operation, when the engine starts, an alternating voltage generated in the exciter coil 41*a* is rectified by the diode D1 and applied to the capacitor C1 in the ignition circuit 33*a* to charge the capacitor.

The pulser coil 41*b* produces a reference signal voltage at a predetermined crank position and the voltage is applied to the gate of the thyristor SCR1 through the diode D3 and the resister R2.

When the voltage reaches a trigger level of the thyristor SCR1, the thyristor SCR1 becomes conductive so that the load charged in the capacitor C1 is discharged to a closed circuit comprising the capacitor C1, thyristor SCR1, primary coils of ignition coils 4*a*, and capacitor C1. Thus, high voltage of an extremely large positive going pulse is produced in the secondary coils of the ignition coils 4*a* to ignite the spark plug 4.

At the same time, the pulse detecting circuit 33*c* detects the waveforms of the pulses for the primary coils which are shaped by the waveform shaping circuit 33*d*, and a predetermined pulse duration of the pulses is determined by the duty control circuit 33*e*. The pulse generating circuit 33*f* generates the CDI pulses in synchronism with the source VIG. The fuel injection pulse is applied to the fuel injector 11 in synchronism with the CDI pulse to start the engine.

In order to stop the engine, the ignition switch 31 or the kill switch 32 is turned off so that off contacts of the switch close. Consequently, the voltage at the source VIG is applied to the gate of the thyristor SCR2 through the resistor R1 and the diode D2 in the ignition source short-circuiting circuit 33*b* to render the thrystor SCR2 conductive. Thus, the source VIG is short-circuited through the resistor R3 and the first diode D4, and the capacitor C2 is charged through the second diode D5.

As shown in FIGS. 3*a*, 3*b*, since the source VIG is the intermittent voltage, the source voltage VIG reduces to a ground level, so that the thyristor SCR2 goes off. Consequently, the capacitor C2 discharges the current which is supplied to the base of the transistor TR to turn on the transistor.

When the source voltage VIG is generated again, the current is directly supplied to the gate of the thyristor SCR2 through the second diode D5, transistor TR, resistor R5, and diode D6. Thus, the thyristor SCR 2 is turned on again to short-circuit the source VIG and to charge the capacitor C2.

This process is repeated so that the necessary energy for igniting the spark plug 4 is not applied to the primary coils of the ignition coils 4. Consequently, the voltage is reduced lower than the limit value for the ignition, thereby stopping the engine.

In the system, if the kill switch 32 is turned off once to turn on the thyristor SCR2, the thyristor SCR2 is automatically turned on and off in accordance with the capacitor C2 and the transistor TR until the engine stops. Therefore, it is not necessary to maintain the kill switch 32 in the off-state.

After the engine stops, the control unit 20 is supplied with the power from the battery through the self-shut relay 29 in a self-hold state. After a predetermined time elapses, the self-shut relay 29 is turned off to cut off the power to the control unit 20 and hence to stop the operation.

Figure 5:
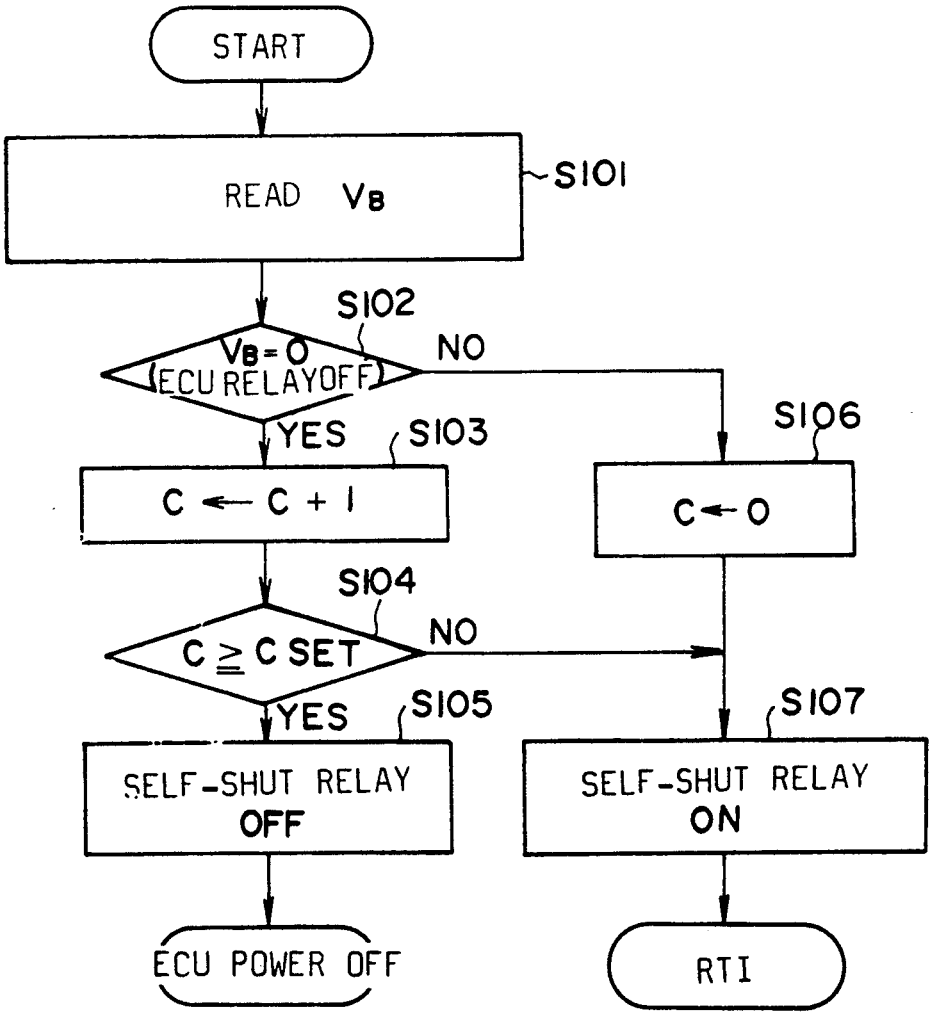
FIG. 5 is a flowchart showing the operation of a self-shut relay.

The operation of the self-shut relay 29 is described hereinafter with reference to the flowchart of FIG. 5. The program is executed as an interruption at every predetermined time while the power is supplied to the control unit 20.

At a step S101, the voltage VB at the terminal of the ECU relay 28 is read. At a step S102, it is determined whether the voltage VB is zero or not, namely, the ECU relay 28 is turned off or not. When VB=0, it is determined that one of the switches 31 and 32 is turned off to turn off the relay 28 so that the engine stops. The program goes to a step S103 where the count C of the counter is incremented with 1 (C←C +1). At a step S104, the count C is compared with the predetermined set value CSET. When C<CSET, it is determined that the engine is still in a hot engine condition. Consequently, the program goes to a step S107 where the self-shut relay 29 is kept turned on and the program is repeated. When C≧CSET, it is determined that the engine is cooled to a predetermined temperature, and the program proceeds to a step S105 where the self-shut relay 29 is turned off to cut off the power to the control unit 20. Thus, the operation is stopped. In other words, the control unit 20 is kept supplied with power for a predetermined period of time after stopping of the engine, thereby maintaining the data for operating the engine for the period. The data stored in the RAM 23 are initialized at restarting of the control unit.

On the other hand, when VB is not 0 at the step S102, it is determined that the ECU relay 28 is turned on and the engine is under operation. The program goes to a step S106 where the count C is cleared (C←0), and the program goes to the step S107.

Figure 6B:
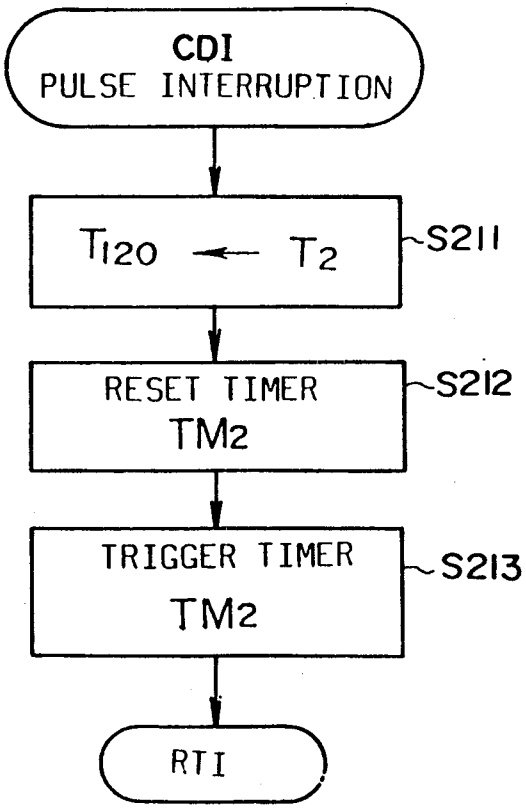
FIGS. 6*a* to 6*c* are flowcharts showing operations of a fuel pump.
Figure 6A:
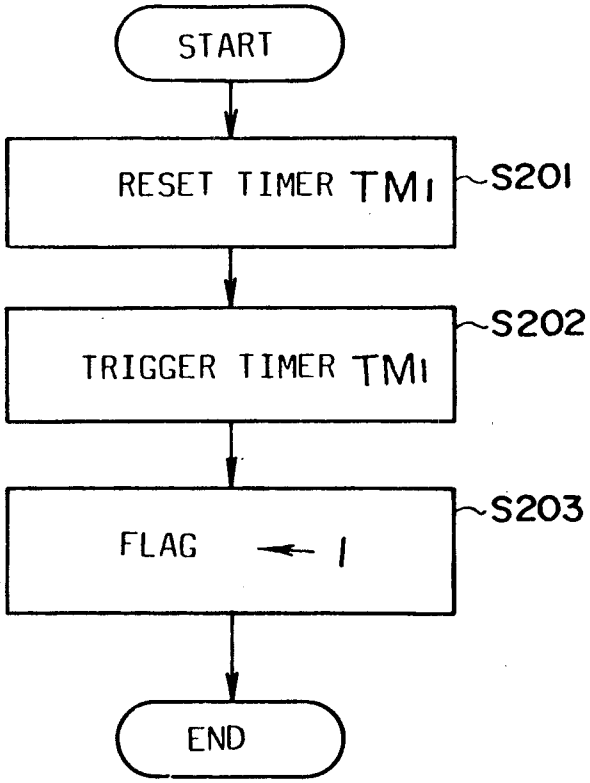
Figure 6C:
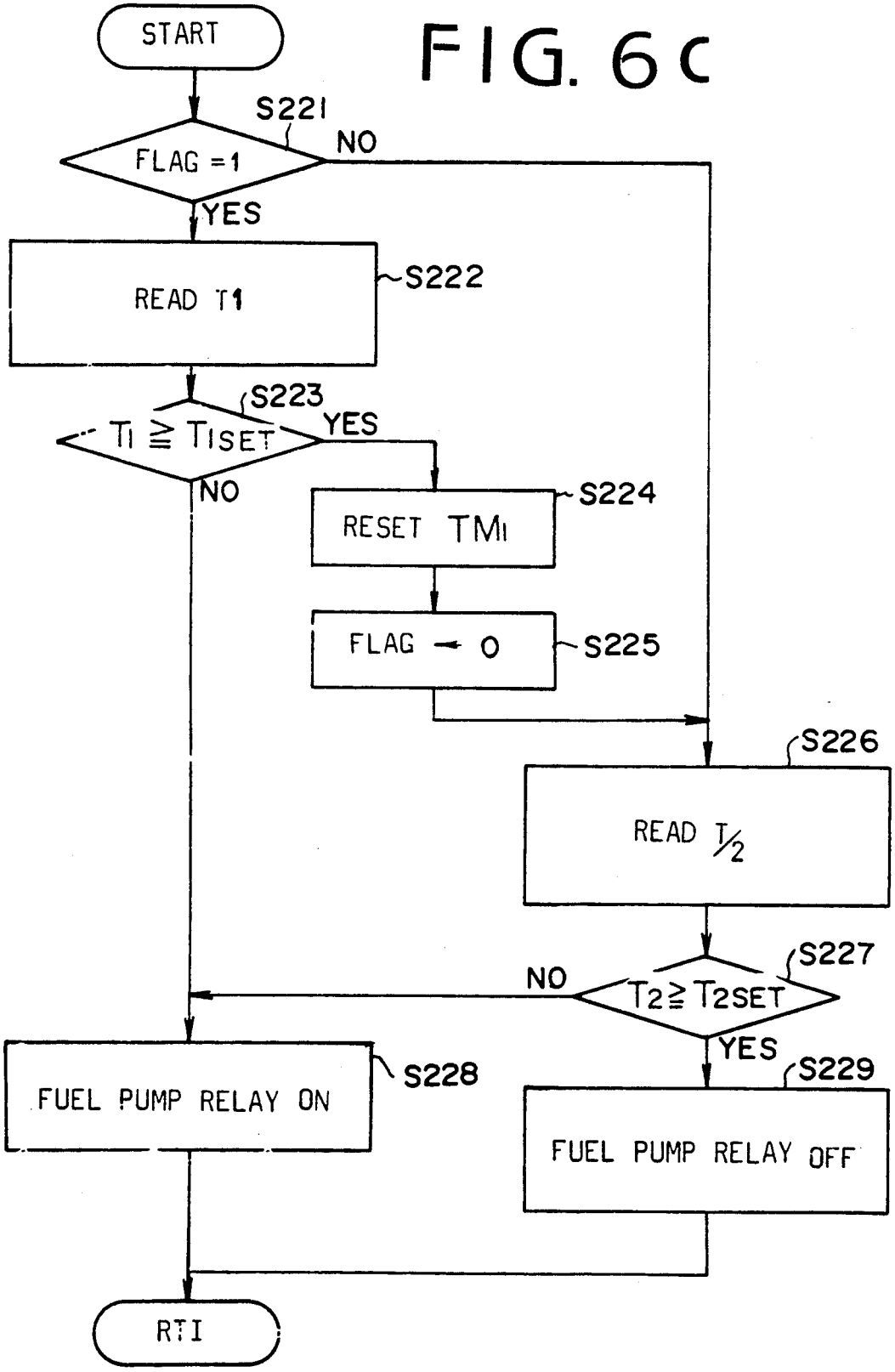

When the ECU relay 28 is turned on in order to start the engine, the programs for controlling the fuel pump shown in FIGS. 6*a*–6*c* are executed. Namely, the ignition switch 31 is turned on to supply the power to the control unit 20 under the condition that the self-shut relay 29 is turned on or off, the program shown in the flowchart of FIG. 6*a* is executed once.

At a step S201, the timer TM1 is initialized. At a step S202, the timer TM1 is actuated to start measuring time. At a step S203, the initial state determining flag FLAG is set (FLAG←1) and the program is terminated.

When the CDI pulses are applied, the program as shown in the flowchart of FIG. 6*b* is executed as an interruption routine.

At a step S211, the measured time T2 of the timer TM2 is stored in a predetermined address of the RAM 23 as the input interval T120 of the CDI pulse from the CDI circuit 33. At a step S212, the timer TM2 is reset. At a step S213, the timer TM2 is started measuring time and the routine is terminated.

If the program is the first time, the program begins at the step S212.

The program shown in the flowchart of FIG. 6c is executed at every predetermined time.

At a step S221, the initial state determining flag FLAG is detected. When FLAG=1, namely the initial state is determined, the program goes to a step S222. When FLAG=0, the program goes to a step S226.

At the step S222, the measured time T1 by the timer TM1 is read. At a step S223, the measured time T1 is compared with the predetermined set time T1SET. When T1<T1SET, it is determined that the initial state is terminated. The program does to a step S228 where the fuel pump relay 34 is turned on to drive the fuel pump 17 and the routine is terminated.

On the other hand, when T1≧T1SET at step S223, the program goes to a step S224 where the timer TM1 is reset. At a step S225, the initial state determining flag FLAG is cleared. After the initial state, at the step S226, the measured time T2 of the timer TM2 is read. At a step S227, the measured time T2 is compared with the predetermined set time T2SET. When T1<TsSET, the program goes to the step S228.

On the other hand, when T2≧T2SET, it is determined that the ignition is cut off. The program goes to a step S229 where the fuel pump relay 34 is turned off to stop the operation of the fuel pump 17, and the routine is terminated.

Figure 7:
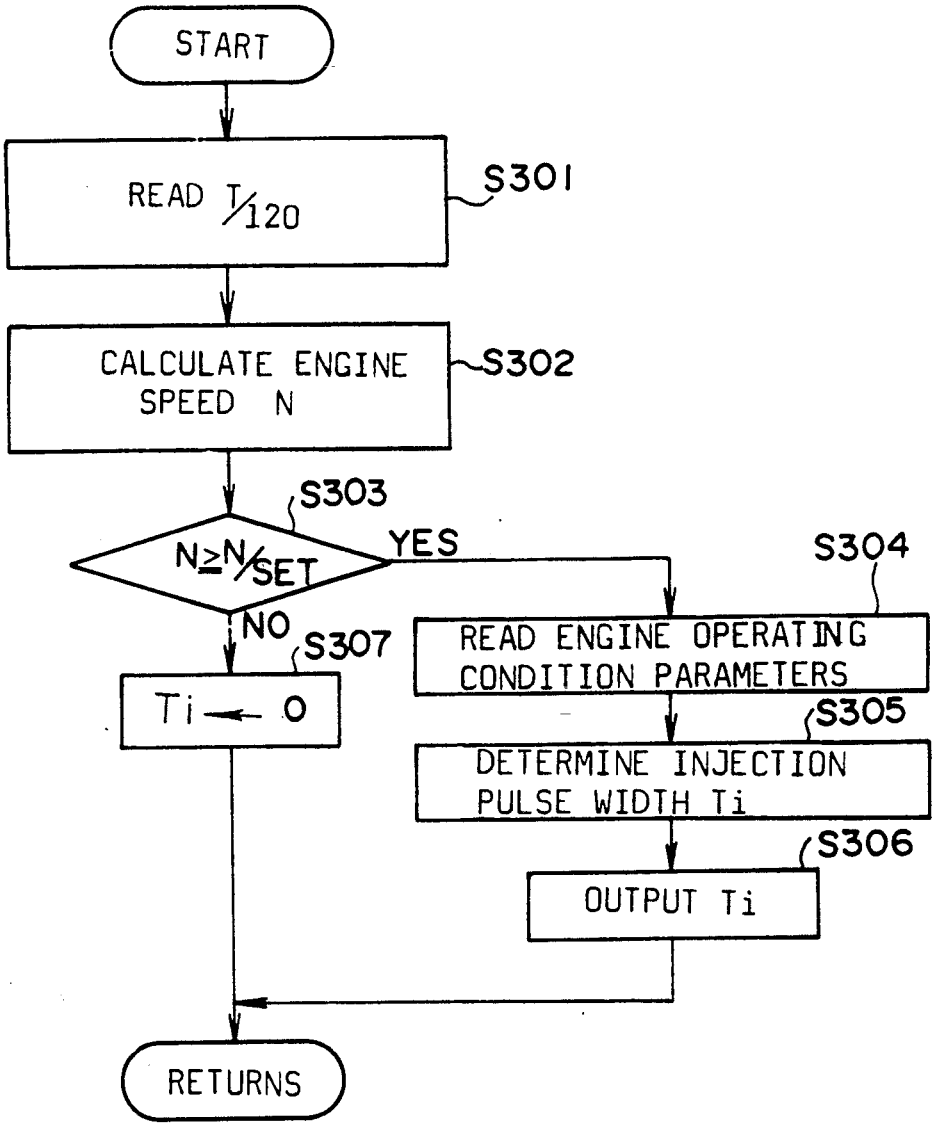
FIG. 7 is a flowchart showing the operation of fuel injection control.

The fuel injection control will be described with reference to the flowchart of FIG. 7.

At a step S301, the CDI pulse input interval T120 stored in the RAM 23 is read. At a step S302, the period f is obtained in accordance with the interval T120, and the engine speed N is calculated in accordance with the period f ($N=60/2\pi f$). At a step S303, the engine speed N is compared with the predetermined set speed NSET. When N≧NSET, it is determined that the engine starts or is in a normal driving condition. The program goes to a step S304 where the engine speed N, battery voltage VB and engine operating condition parameters are read. At a step S305, the fuel injection pulse width Ti is determined based on the engine operating condition parameters. At a step S306, the drive signal in dependency on the fuel injection pulse width Ti is applied to the fuel injector 11 and the routine is terminated.

When N<NSET at the step S303, it is determined that the engine speed N is reduced because the ignition is cut off. The program goes to a step S307 where the fuel injected from the fuel injector is cut off (Ti←0) and the routine is terminated.

Figure 8A:
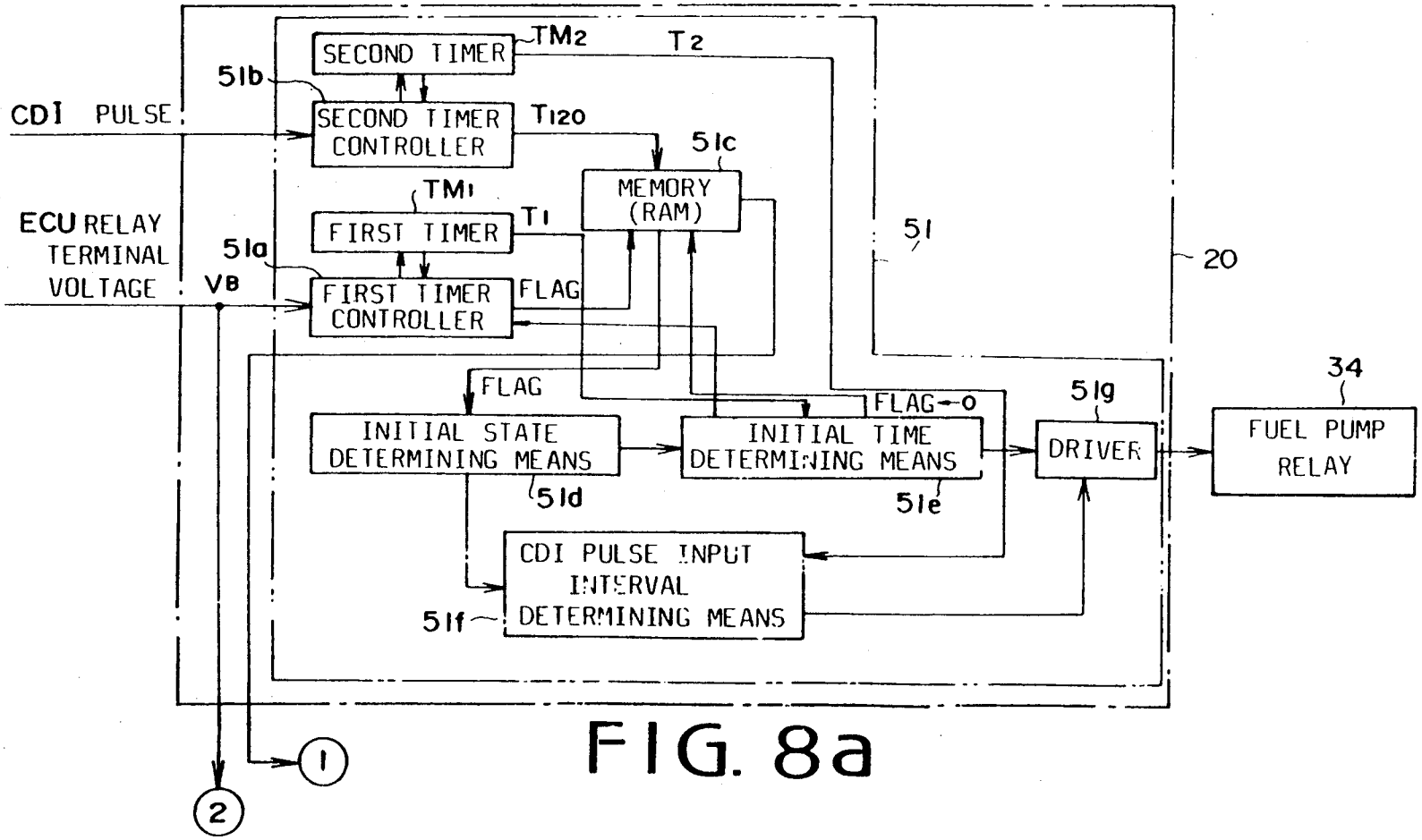
FIGS. 8*a* and 8*b* shows a block diagram showing a second embodiment of the invention.
Figure 8B:
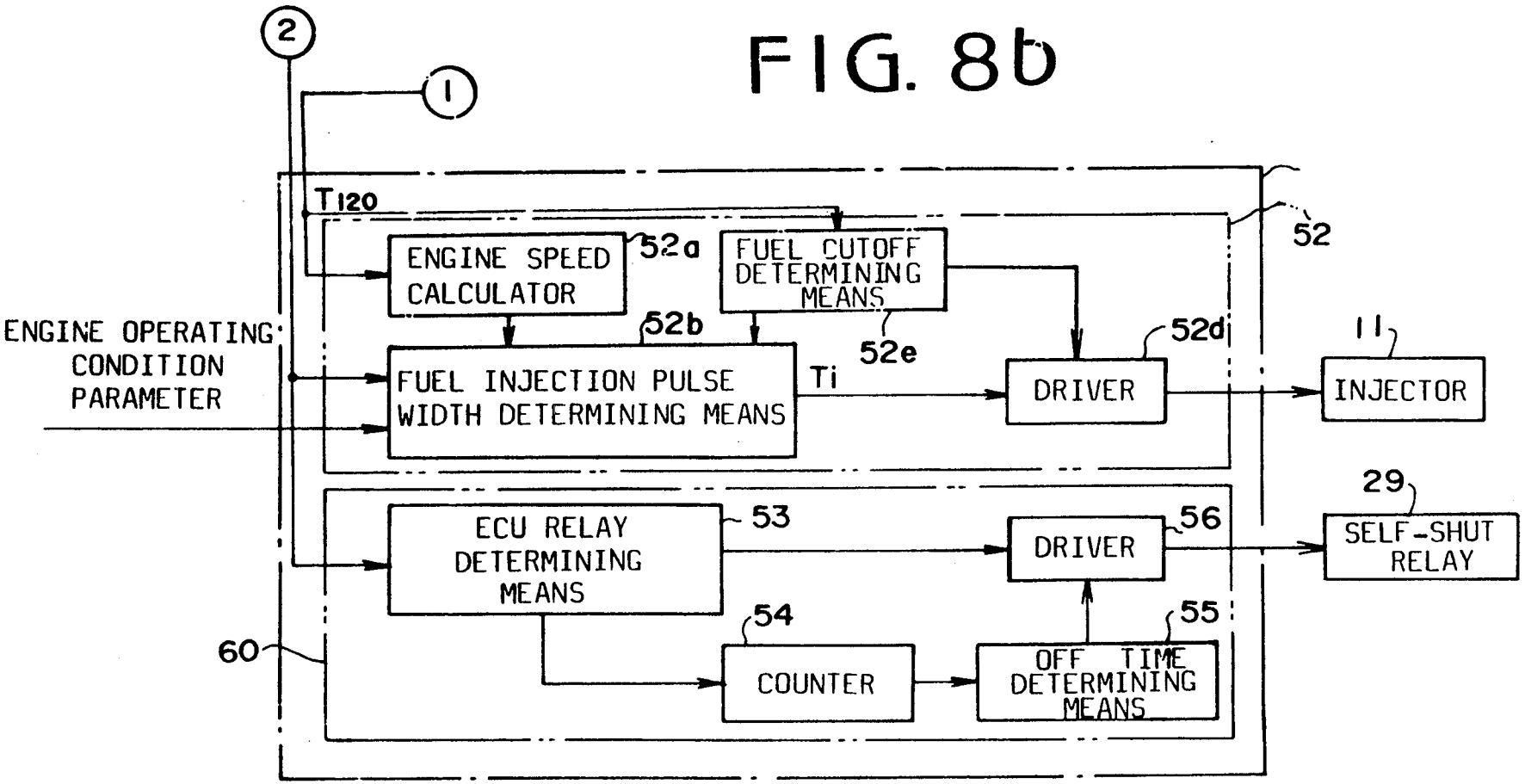
Figure 9:
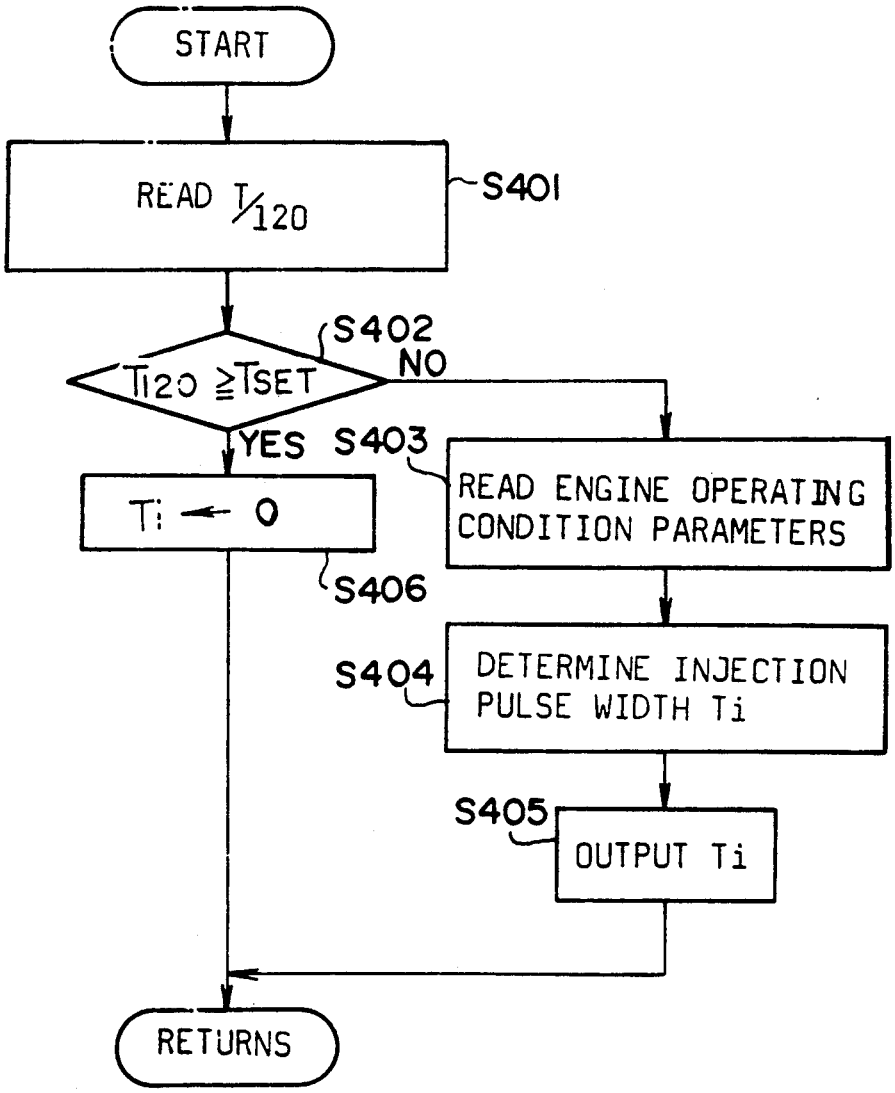
FIG. 9 is a flowchart showing the operation of the second embodiment.

FIGS. 8a, 8b and 9 show the second embodiment.

Referring to FIGS. 8a, 8b the fuel injection control section 52 of the second embodiment is provided with a fuel cutoff determining means 52e to which the CDI pulse input interval T120 is applied from the memory 51c for determining to cut off the fuel injection. The fuel cutoff determining means 52e is provided with a predetermined set time TSET (for example 0.4 sec.) which is compared with the interval T120. When T120≧TSET, it is determined that the CDI pulse is not applied because the ignition is cut off. When T120<TSET, the normal operation of the engine is determined. The means 52e sends the signal to the fuel injection pulse width determining means 52b to actuate the means 52b in the same manner as the first embodiment shown in FIG. 2.

Referring to FIG. 9 showing the operation of the fuel injection, at the step S401, the CDI pulse input interval T120 is read. At a step S402, the interval T120 is compared with the predetermined set time TSET. When T120<TSET, it is determined that the engine is in a normal driving state and the program goes to a step S403. When T120≧TSET, it is determined that the ignition is cut off and the program goes to the step S406. At steps S403 to S406, the programs are executed in the same manner as the first embodiment shown in the flowchart of FIG. 7.

Figure 10:
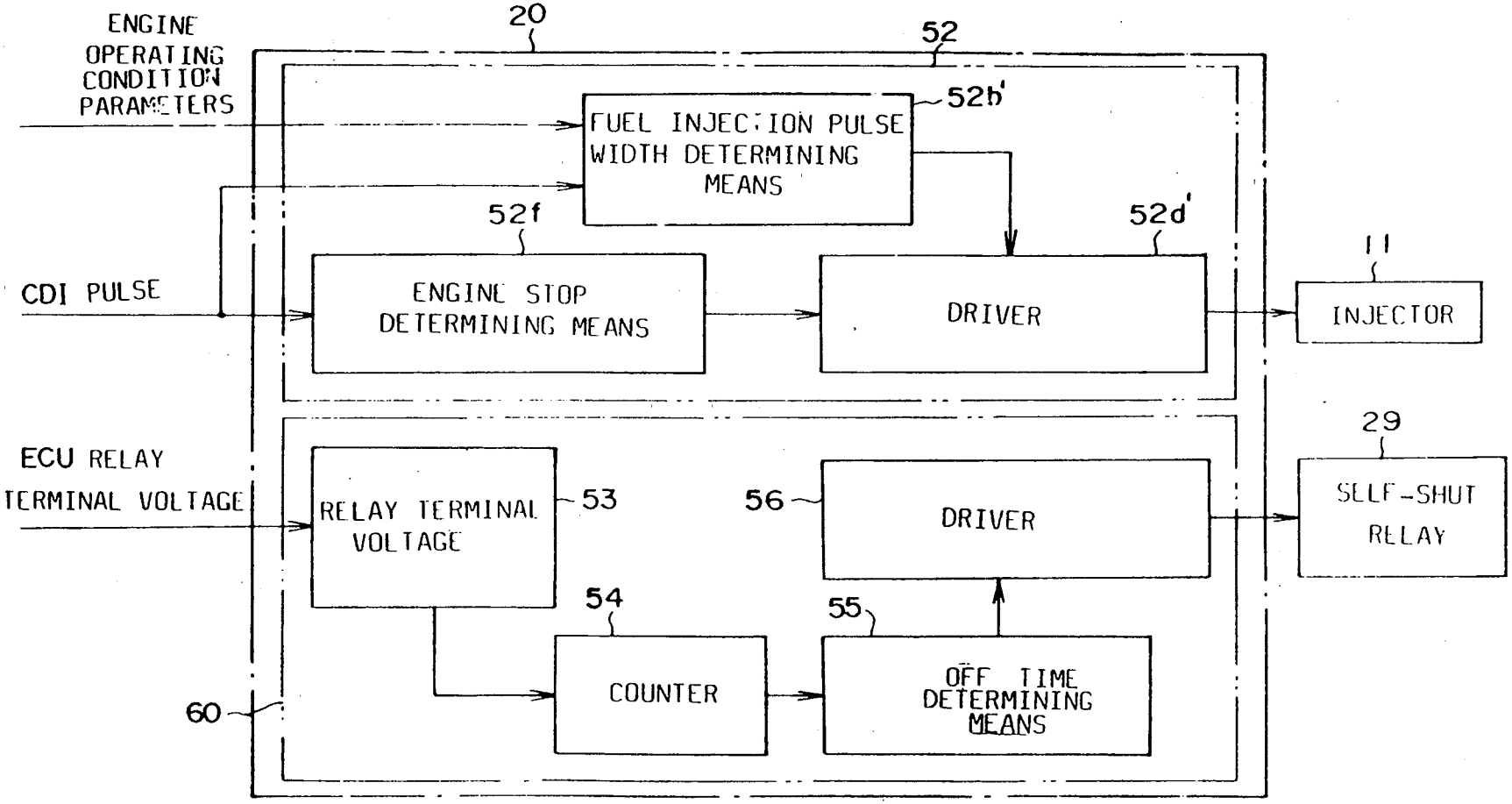
FIG. 10 is a block diagram showing a third embodiment.
Figure 11:
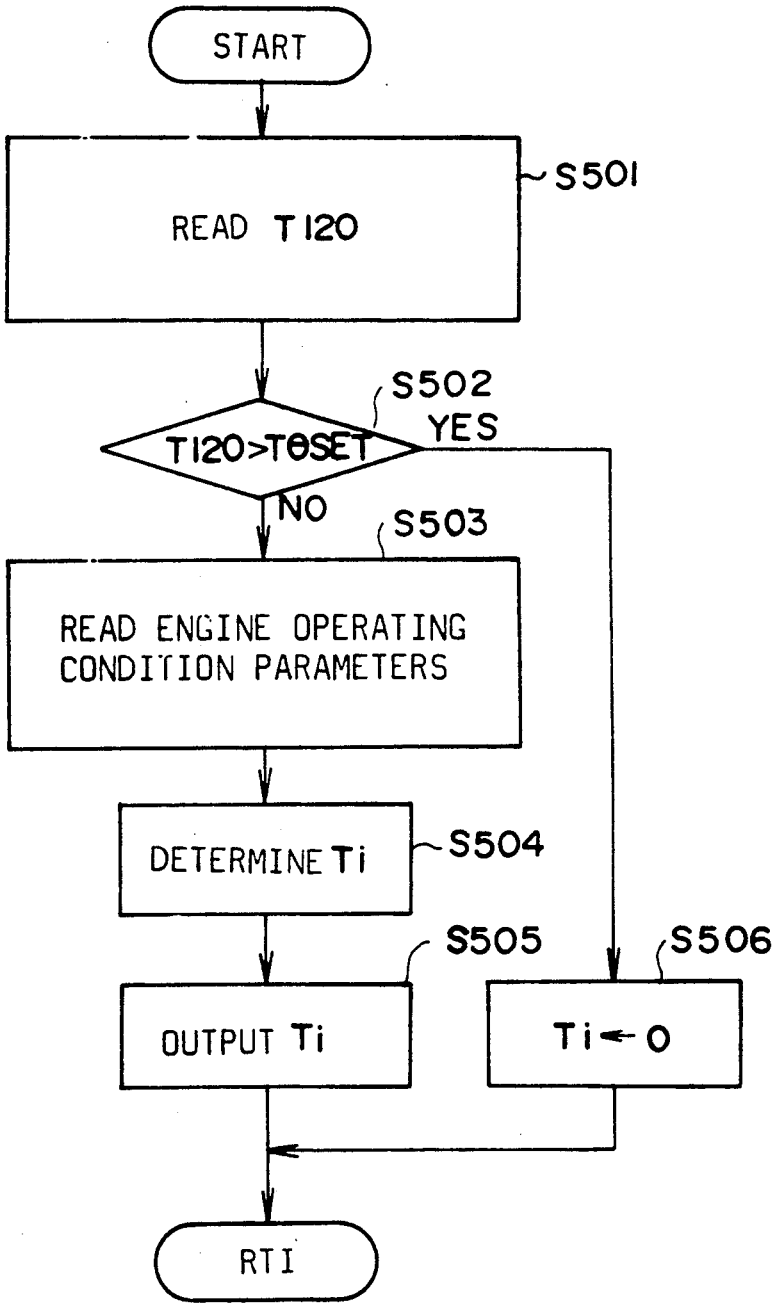
FIG. 11 is a flowchart showing the operation of the third embodiment.

Referring to FIGS. 10 and 11 showing the third embodiment, the fuel injection control section 52 comprises a fuel injection pulse width determining means 52b' in which the engine speed N is calculated in accordance with the CDI pulse input interval T120, and a basic fuel injection pulse width Tp is determined based on the engine speed N and the throttle opening degree $\alpha$. The basic fuel injection pulse width Tp is corrected in accordance with a correcting coefficient COEF determined from the engine operating condition parameters such as the crankcase temperature Tmc and the intake air temperature Ta in order to increase the amount of injection fuel. The fuel injection pulse width Ti is determined by a calculation of Ti=Tp×COEF. The fuel injection pulse width Ti is applied to a driver 52d' which produces a driving signal at the predetermined timing for operating fuel injector 11.

An engine stop determining means 52f is provided for determining the stopping of the engine in accordance with the CDI pulse input interval T120. When one of the switches 31 and 32 is turned off in order to stop the engine, the line of the CDI unit 33 is connected to the ground so that the value of the CDI pulse is rapidly reduced. The means 52f is provided with a predetermined standard time TθSET for determining the stopping of the engine which is compared with the CDI pulse input interval T120. When T120>TθSET, it is determined that the engine is stopped. An output signal is applied to the driver 52d' for forcibly stopping the output of the driving signal to the injector 11 (Ti←0).

Thus, the stopping of the engine is determined immediately after the time TθSET elapses. The time TθSET is for example 0.4 sec. which is longer than the pulse width corresponding to the engine speed at starting of the engine.

Describing the operation with reference to FIG. 11, at a step S501, the input interval T120 of the CDI pulse is read. At a step S502, the interval T120 is compared with the standard time TθSET. When T120≦TθSET, it is determined that the engine is in a normal driving state, and the program goes to a step S503. When T120>TθSET, it is determined that the engine is stopped, and the program goes to a step S506. At steps S503 to S506, the same programs of the flowchart shown in FIG. 7 of the first embodiment are executed.

In accordance with the present invention, since the fuel injected from the fuel injector is stopped before the fuel pump stops, the fuel pressure is maintained at a proper value. Thus, the starting characteristic of the engine is improved. Furthermore, the power is supplied to the electronic control unit for a predetermined period after the engine stops. Consequently, at restarting of the engine within the period, the engine is easily started, since the data before the engine stops are stored in the control unit.

While the presently preferred embodiments of the present invention have been shown and described, it is to be understood that these disclosures are for the purpose of illustration and that various changes and modifications may be made without departing from the scope of the invention as set forth in the appended claims.

What is claimed is:

1. A fuel injection control system for an internal combustion engine having a fuel pump, an ignition coil, a fuel injector receiving fuel from the fuel pump through a fuel passage, and an electronic control unit for controlling operation of the engine comprising:

an ignition device for intermittently producing an ignition voltage in synchronism with speed and crank position of said engine for exciting said ignition coil;

fuel injection means for operating said fuel injector for injecting fuel in accordance with engine operating conditions;

first stopping means for stopping said fuel injection means from injecting fuel in accordance with engine operating conditions when the engine stops to at least a first predetermined minimum value;

second stopping means for stopping the fuel pump after the stopping of the fuel injection means from injecting fuel in accordance with engine operating conditions when the engine stops to at least a second predetermined minimum value, said second predetermined minimum value being smaller than said first predetermined minimum value, said electronic control unit operating said fuel pump after the stopping of the fuel injection means from injecting fuel until said second stopping means stops the fuel pump so as to maintain pressure in the fuel passage to enable easy restarting of the engine.

2. The system according to claim 1 further comprising means for supplying power to said electronic control unit for a predetermined period after the stopping of the engine for storing data for restarting the engine.

3. The system according to claim 1, wherein said first stopping means includes first determining means for determining when the engine stops to at least the first predetermined minimum value by comparing the interval of ignitions with a first reference value; and said second stopping means includes second determining means for determining when the engine stops to at least the second predetermined minimum value by comparing the interval of the ignitions with a second reference value.

4. The system according to claim 1, wherein said first stopping means stops fuel injection when speed of the engine becomes lower than a predetermined speed.

5. The system according to claim 1, wherein said fuel injection means is responsive to said ignition voltage for controlling fuel injection timing.

6. A method for controlling a system for an internal combustion engine having a fuel pump, an ignition coil, a fuel injector receiving fuel from the fuel pump through a fuel passage, and an electronic control unit for controlling operation of the engine, comprising the steps of:

intermittently producing an ignition voltage in synchronism with speed and crank position of said engine for exciting the ignition coil;

operating the fuel injector for injecting fuel in accordance with engine operating conditions;

stopping the fuel injecting in accordance with engine operating conditions when the engine has stopped to at least a first predetermined minimum value; and thereafter stopping the fuel pump in accordance with engine operating conditions when the engine has stopped at least to a second predetermined minimum value, said second predetermined minimum value being smaller than said first predetermined minimum value, so as to maintain pressure in the fuel passage to enable easy restarting of the engine.

7. A fuel injection control system for an internal combustion engine having a fuel pump, an ignition coil, a fuel injector receiving fuel from the fuel pump through a fuel passage, and an electronic control unit for controlling operation of the engine comprising:

an ignition device for intermittently producing an ignition voltage in synchronism with speed and crank position of said engine for exciting said ignition coil;

fuel injection means for operation said fuel injector for injecting fuel in accordance with engine operating conditions;

first stopping means for stopping said fuel injection means from injecting fuel in accordance with engine operating conditions when the engine stops to at least a predetermined minimum value; and second stopping means for stopping the fuel pump after the stopping of the fuel injection means from injecting fuel in accordance with engine operating conditions, said electronic control unit operating said fuel pump after the stopping of the fuel injection means from injecting fuel until said second stopping means stops the fuel pump so as to maintain pressure in the fuel passage to enable easy restarting of the engine.

8. The system according to claim 1, wherein said second stopping means includes determining means for determining when the engine stops to at least the second predetermined minimum value by comparing the interval of the ignitions with a reference value and determining if the interval is equal to or greater than the reference value, and said second stopping means producing a signal for stopping the fuel pump when said second stopping means determines that the interval is equal to or greater than the reference value.

* * * * *